US008899150B2

(12) United States Patent
Walker et al.

(10) Patent No.: US 8,899,150 B2
(45) Date of Patent: Dec. 2, 2014

(54) REDUCTION OF PRINT HEAD TEMPERATURE BY DISRUPTING AIR FROM HEATED WEBS OF PRINT MEDIA

(71) Applicants: Casey E. Walker, Boulder, CO (US); Scott Johnson, Erie, CO (US); Stuart J. Boland, Denver, CO (US); William Edward Manchester, Erie, CO (US); David M Price, Loveland, CO (US)

(72) Inventors: Casey E. Walker, Boulder, CO (US); Scott Johnson, Erie, CO (US); Stuart J. Boland, Denver, CO (US); William Edward Manchester, Erie, CO (US); David M Price, Loveland, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/666,806

(22) Filed: Nov. 1, 2012

(65) Prior Publication Data

US 2014/0116275 A1 May 1, 2014

(51) Int. Cl.
*B41F 35/00* (2006.01)

(52) U.S. Cl.
USPC ..... 101/424.1; 101/488

(58) Field of Classification Search
USPC ..... 101/424.1
See application file for complete search history.

(56) References Cited

U.S. PATENT DOCUMENTS

| | | | | |
|---|---|---|---|---|
| 2,907,119 | A * | 10/1959 | Kane | 34/655 |
| 3,549,070 | A * | 12/1970 | Downham et al. | 242/615.11 |
| 4,741,113 | A * | 5/1988 | Burdick et al. | 34/92 |
| 4,910,528 | A | 3/1990 | Firl | |
| 5,424,767 | A | 6/1995 | Alavizadeh | |
| 5,440,821 | A | 8/1995 | Hamrin | |
| 6,340,225 | B1 | 1/2002 | Szlucha | |
| 6,401,358 | B1 | 6/2002 | Bar | |
| 6,427,594 | B1 | 8/2002 | Secor | |
| 6,484,975 | B1 | 11/2002 | Elrod | |
| 6,508,550 | B1 * | 1/2003 | Eastlund et al. | 347/102 |
| 6,536,863 | B1 | 3/2003 | Beauchamp | |
| 7,591,224 | B2 * | 9/2009 | Bock et al. | 101/488 |
| 7,966,743 | B2 * | 6/2011 | Piatt et al. | 34/82 |
| 2007/0079719 | A1 * | 4/2007 | Rohde et al. | 101/487 |
| 2007/0245916 | A1 * | 10/2007 | Bird et al. | 101/416.1 |
| 2009/0207223 | A1 | 8/2009 | Cofler | |
| 2010/0188469 | A1 | 7/2010 | Ikegami | |
| 2010/0245513 | A1 | 9/2010 | Ihara | |
| 2011/0242164 | A1 | 10/2011 | Miura | |
| 2011/0249060 | A1 | 10/2011 | Sakata | |

* cited by examiner

*Primary Examiner* — Anthony Nguyen
(74) *Attorney, Agent, or Firm* — Duft Bornsen & Fettig LLP

(57) ABSTRACT

Systems and methods are provided for reducing the temperature of print heads of a printer in a multi-printer environment. The system comprises a receiving printer operable to receive a web of print media heated by an upstream dryer. The system further comprises an airflow generator located immediately before the heated web enters the receiving printer, the airflow generator operable to project impinging air that deflects warm air proximate to the heated web.

18 Claims, 8 Drawing Sheets

REDUCTION OF PRINT HEAD TEMPERATURE BY DISRUPTING AIR FROM HEATED WEBS OF PRINT MEDIA

FIELD OF THE INVENTION

The invention relates to the field of printing, and in particular, to systems that prevent overheating of print heads.

BACKGROUND

In continuous-forms printing systems, one or more marking engines are used to apply marking material (e.g., aqueous ink) onto a web of print media. The web is driven through the marking engines and into a dryer. The dryer proceeds to heat the web and dry the marking material onto the web. During this process, the web moves quickly across the printing system in order to enable fast printing speeds. For example, the web may travel at many linear feet per second through the printing system.

In continuous-forms printing systems with multiple marking engines, an upstream marking engine may be used to mark one side of the web, while a downstream marking engine may be used to mark the other side of the web. In order to avoid smearing the marking material during printing on the downstream marking engine, a dryer will typically be placed between the upstream and downstream marking engine in order to dry the web before it enters the second marking engine. The dryer heats the web in order to affix the marking material onto the web.

Unfortunately, print heads of marking engines should be maintained within a relatively narrow operating range of temperature. If the operating temperature range of the print heads is not maintained, the physical properties of the marking material (e.g., its viscosity) may be altered, which may have a detrimental effect on print quality, and may even clog a print head. This problem is compounded when heat from the dried web contributes to the heat generated within the downstream marking engine.

Existing systems use chilled rollers to reduce the temperature of a web back to ambient temperature after the web has been dried and before the web enters the downstream marking engine. However, this process takes up valuable floor space at a print shop, and also consumes a great deal of power, which increases the expense of printing operations.

SUMMARY

Embodiments described herein deflect/disrupt heated air that is next to a heated web of print media, just before the web enters a printer that is downstream from a dryer. By disrupting the boundary layer, the air that has been conductively and convectively heated by the dried web is dispersed and pushed away before it reaches the print heads of the printer. Thus, when the web passes by the print heads of the printer, it contributes less heat to the print heads. At the same time, because the boundary layer has been disrupted (e.g., without substantially affecting the heat of the web itself), the web remains warm when it enters a next dryer. Thus, the next dryer may expend less energy to dry the web.

One embodiment is a system that prevents overheating of print heads of a printer (e.g., in a multi-printer environment). The system comprises a receiving printer operable to receive a web of print media heated by an upstream dryer. The system further comprises an airflow generator located immediately before the heated web enters the receiving printer. The airflow generator is operable to project impinging air that deflects warm air proximate to the heated web.

Another embodiment is a method for preventing overheating of print heads of a printer (e.g., in a multi-printer environment). The method comprises driving a heated web of print media to a dryer. The method also comprises heating the marked web at the dryer, and driving the heated web toward a receiving printer. Further, the method comprises projecting impinging air onto the heated web with an airflow generator immediately before the heated web enters the receiving printer in order to deflect warm air proximate to the heated web, and marking the heated web with the receiving printer.

Another embodiment is a further system that for preventing overheating of print heads of a printer (e.g., in a multi-printer environment). The system comprises a receiving printer and a wall. The receiving printer is operable to mark a heated web of print media that has been heated by a upstream printer. The wall is tangent to the heated web and located immediately before the heated web enters the receiving printer. The wall is operable to physically deflect air proximate to the heated web as the web travels past the wall.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
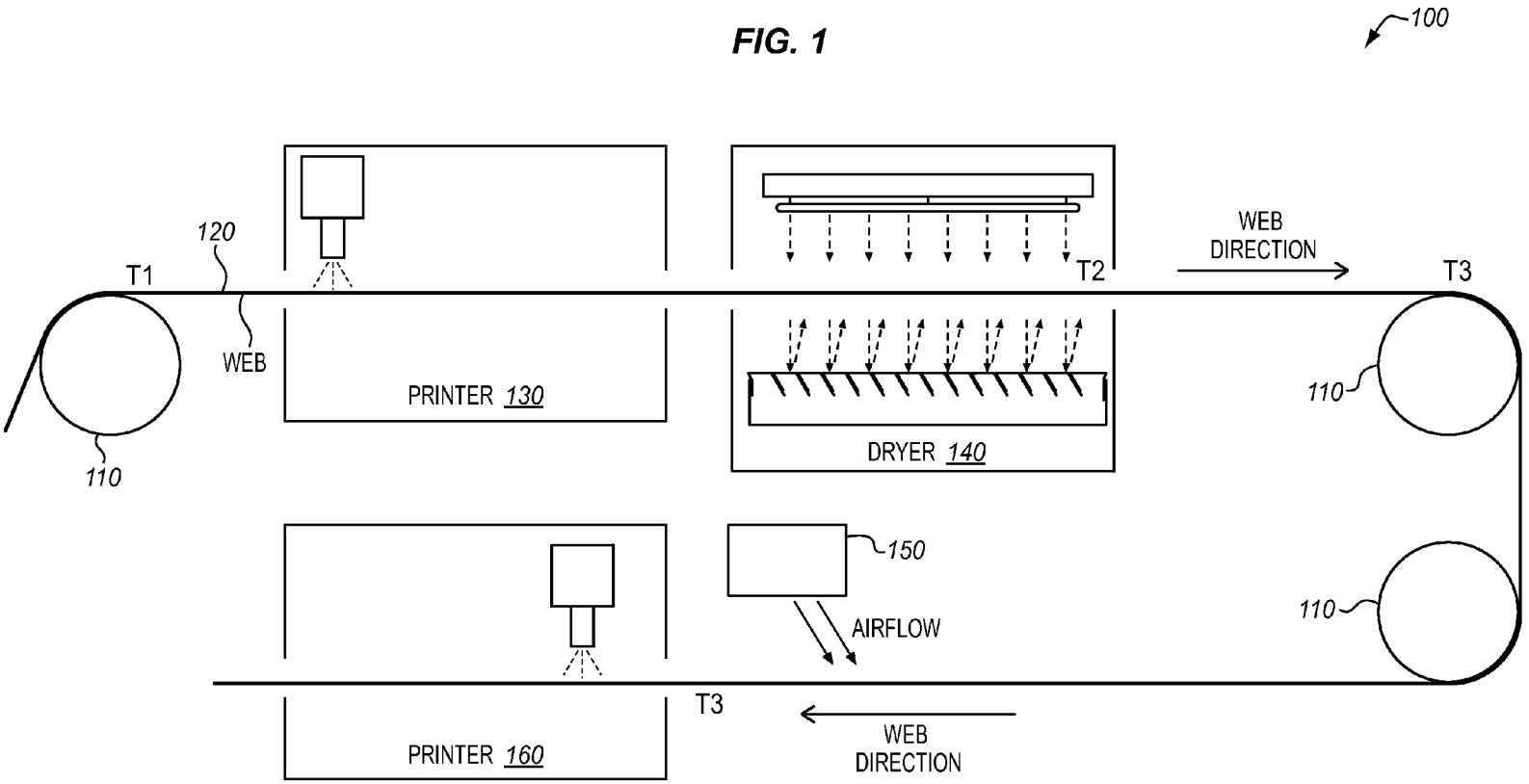
FIG. 1 is a block diagram of a printing system in an exemplary embodiment.

FIG. 1 is a block diagram of a printing system 100 in an exemplary embodiment. Printing system 100 comprises any system, component, or set of devices operable to print incoming print jobs. In this embodiment, printing system 100 drives a web of print media from an upstream printer 130 to dryer 140, and then to a downstream printer 160. This means that downstream printer 160 will be marking a heated portion of the web. Fortunately, printing system 100 has been enhanced to reduce the chances that downstream printer 160 will overheat, even though printer 160 marks a heated web of print media. Printing system 100 achieves this goal by using an airflow generator 150 to disrupt a boundary layer of heated air on the web that would otherwise cause heating at printer 160.

In this embodiment, printing system 100 comprises a continuous-forms printing system that includes rollers 110, web 120, printers 130 and 160, dryer 140, and airflow generator 150.

Rollers 110 position web 120 as it travels throughout printing system 100. Rollers 110 may be used in combination with each other, and may apply tension to web 120. Further, one or more rollers 110 may be driven by an outside force (e.g., a motor) to move web 120 through printing system 100. Rollers 110 that move damp portions of web 120 will preferably be oriented so that these damp portions do not directly contact a surface of the roller and smear.

Web 120 travels across printing system 100, and is printed upon by both upstream printer 130 and downstream printer 160. Before web 120 enters upstream printer 130, web 120 is at a first temperature T1 (e.g., the ambient temperature of the print shop). Web 120 is then heated to temperature T2 by dryer 140, and cools to a temperature T3 (which is greater than ambient temperature) by the time it arrives at downstream printer 160. Web 120 may comprise any suitable media capable of receiving marking material. For example, web 120 may comprise a web of paper.

Upstream printer 130 marks web 120 as web 120 travels through it. For example, printer 130 may comprise a print controller operable to interpret received print data, as well as a marking engine made up of one or more print heads that disperse marking material onto web 120.

Dryer 140 dries web 120 after it exits printer 130. Dryer 140 comprises any system, component, or device operable to dry marking material onto web 120. In this embodiment, dryer 140 comprises an enclosed radiant dryer that includes a radiant heating element. As web 120 travels through the interior of dryer 140, the heating element applies radiant heat in order to heat web 120 to temperature T2 and thereby affix damp marking material onto web 120.

Airflow generator 150 is an enhanced system that forces air onto web 120. This forced air deflects and/or disrupts a heated boundary layer of air on web 120 immediately prior to web 120 entering downstream printer 160. This ensures that heated air on top of web 120 does not contribute to heating print heads of printer 160.

Airflow generator 150 comprises any system, component, or device operable to apply a high-velocity impinging stream of air onto a surface of web 120. This ensures that air flow is focused and uniform when it strikes the surface of web 120. For example, airflow generator 150 may comprise an airknife, high-speed fan (axial, centrifugal, crossflow), air nozzle, carefully dimensioned ducting, etc. Airflow generator 150 applies a very high velocity flow of gas (e.g., tens of meters per second) in order to disrupt any boundary layer formed on web 120. The air applied by airflow generator 150 may comprise ambient air, or may comprise ambient air combined with one or more gases.

In one embodiment, a controller for airflow generator 150 may adjust the velocity, mass flow, mix of air, or temperature of air applied by airflow generator 150. The adjustments may be made as a function of the speed of web 120 as it travels through printing system 100. Such a controller may be implemented, for example, as custom circuitry, a processor executing instructions stored in memory, etc.

Downstream printer 160 marks web 120 after web 120 travels past airflow generator 150. For example, printer 160 may include a print controller operable to interpret print data, as well as a marking engine made up of one or more print heads that disperse marking material onto web 120. In dual-side printing applications, web 120 may be oriented so that a previously unprinted side of web 120 is marked by the marking engine of printer 160.

Figure 2:
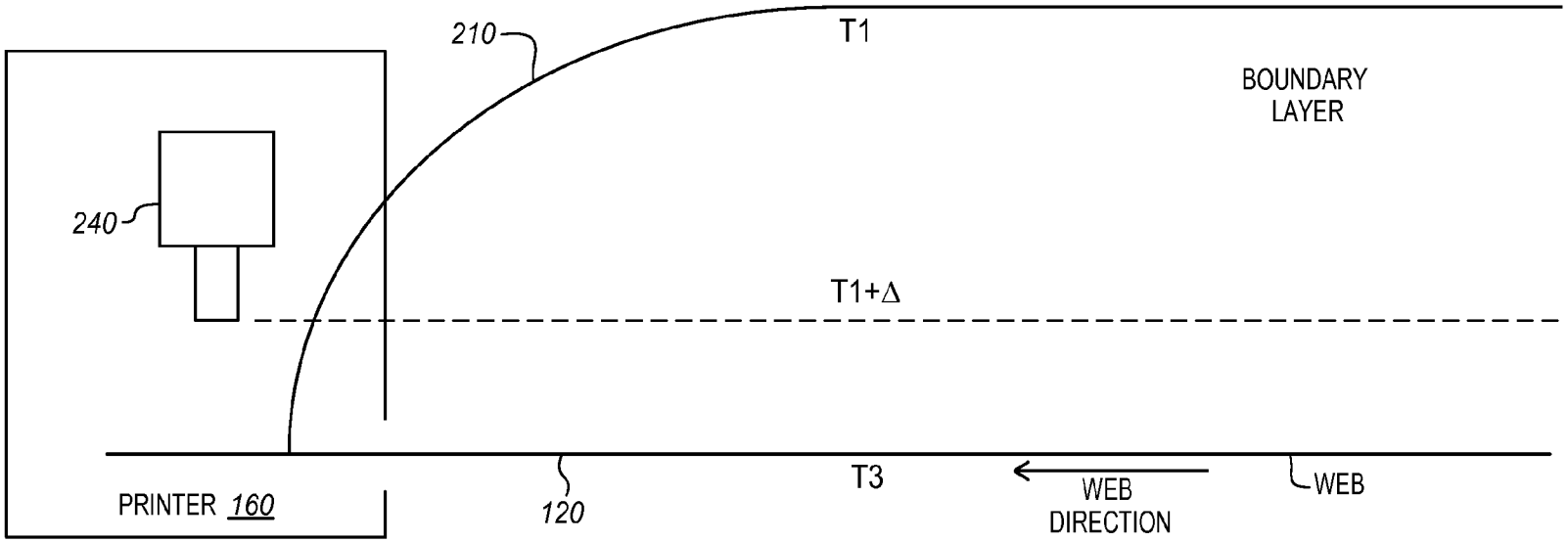
FIG. 2 is a block diagram illustrating a boundary layer on a heated web of print media in an exemplary embodiment.

FIG. 2 is a block diagram illustrating a side view of a boundary layer 210 on a heated web of print media 120 in an exemplary embodiment. According to FIG. 2, print head 240 of printer 160 is located within a few millimeters (e.g., 11 mm) of web 120. This means that air from boundary layer 210 will travel across print head 240 as print head 240 is printing. Boundary layer 210 includes air that has been heated by web 120, and the heated air that will pass print head 240 will be at some temperature above ambient temperature (i.e., T1+Δ). Because of this, the air will heat print head 240 (or will at least hamper the cooling of print head 240), which may impact print quality by changing the viscosity of marking material, or even by clogging print head 240.

Figure 3:
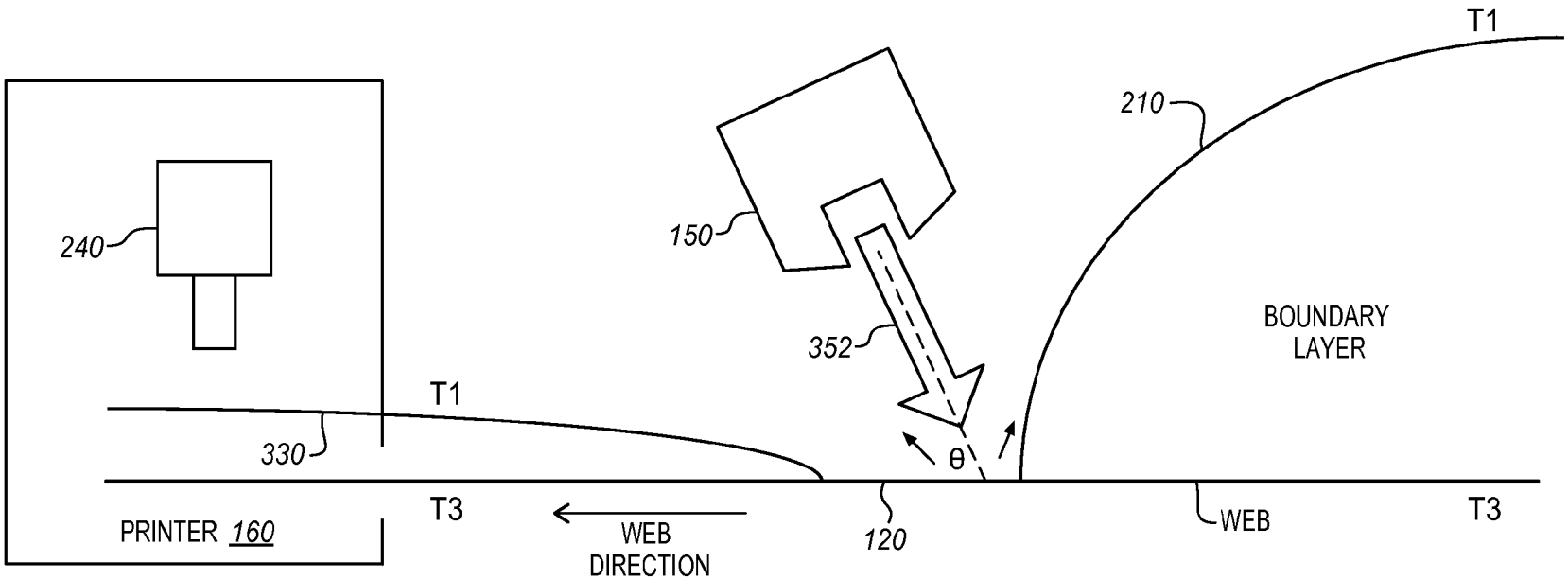
FIG. 3 is a block diagram of an airflow generator used to disrupt a boundary layer on a web of print media in an exemplary embodiment.

FIG. 3 is a block diagram of an airflow generator 150 used to disrupt a heated boundary layer 210 on a web of print media 120 in an exemplary embodiment. In FIG. 3, airflow generator 150 is shown forcing high-velocity air flow onto web 120. The air flow disrupts boundary layer 210 to form chaotic flow (e.g., turbulent flow). In this way, heated air from boundary layer 210 may be disrupted/deflected so that it is pushed away and does not travel past print head 240.

Naturally, heated web 120 may begin re-heating the surrounding environment after boundary layer 210 has been disrupted, thereby forming another boundary layer 330. However, boundary layer 330 will remain fairly small until enough time has passed to heat boundary layer 330 back to a steady state. Because web 120 moves underneath print head 240 while boundary layer 330 is still being heated to a steady state by web 120, the impact of boundary layer 330 on heating web 120 is negligible, or at least is diminished. According to FIG. 3, it may be desirable to orient airflow generator 150 to an impinging angle (θ) so that impinging air flow from airflow generator 150 deflects away from print head 240 (e.g., an angle less than ninety degrees). High velocity airflow may otherwise potentially interfere with the application of marking material by print head 240, which may reduce print quality. Illustrative details of the operation of printing system 100 will be discussed with regard to FIG. 4.

Figure 4:
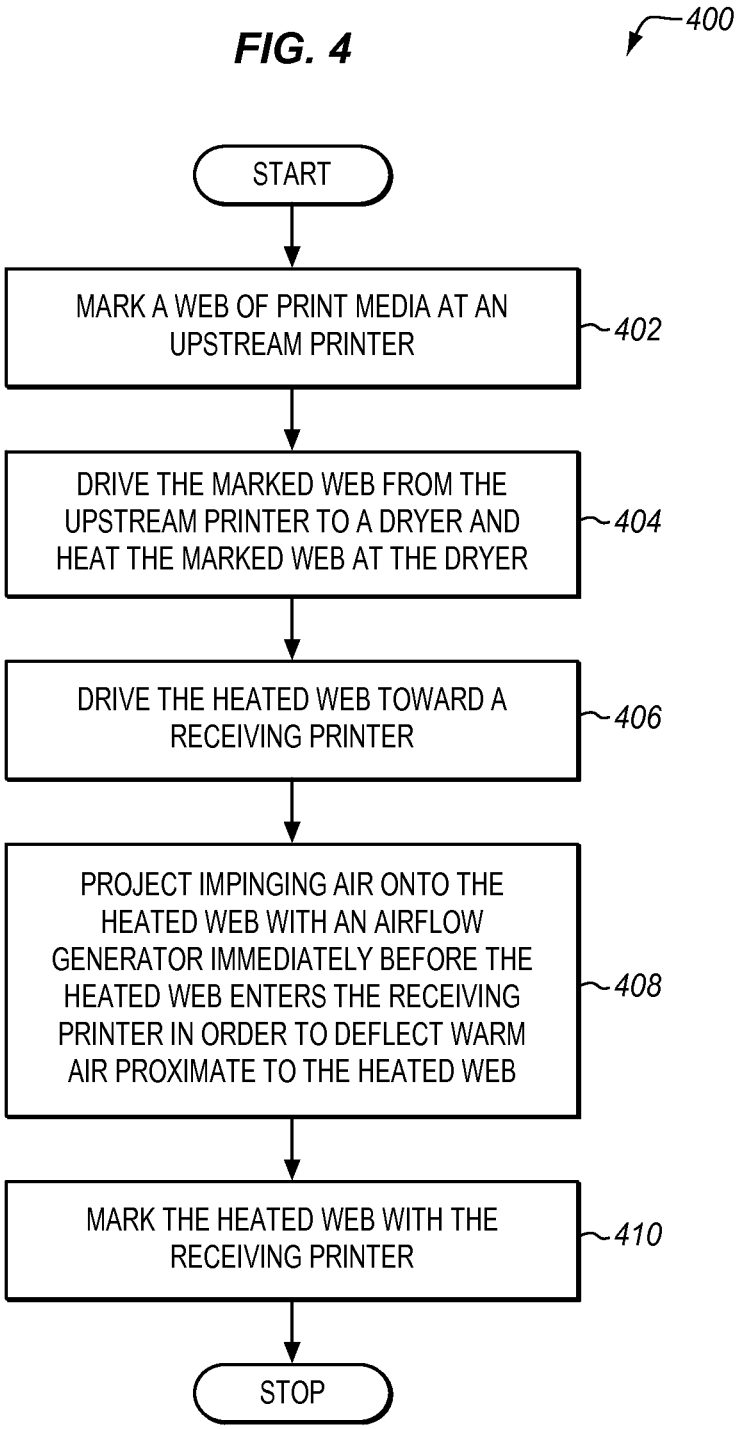
FIG. 4 is a flowchart illustrating a method for disrupting boundary layers of air on a heated web of print media in an exemplary embodiment.

FIG. 4 is a flowchart illustrating a method 400 for disrupting boundary layers of air on a heated web of print media in an exemplary embodiment. The steps of method 400 are described with reference to printing system 100 of FIG. 1, but those skilled in the art will appreciate that method 400 may be performed in other systems. The steps of the flowcharts described herein are not all inclusive and may include other steps not shown. The steps described herein may also be performed in an alternative order.

Assume, for this embodiment, that printing system 100 has initiated printing of an incoming job. Thus, in step 402 upstream printer 130 marks web 120. In step 404, web 120 is driven to dryer 140. Printed portions of web 120 are then heated to a temperature T2 by dryer 140, and cooled by the ambient air to a temperature T3 before reaching airflow generator 150. In step 406, heated web 120 is driven towards downstream printer 160. Heated web 120 continues moving toward downstream printer 160 until it reaches airflow generator 150.

In step 408, airflow generator 150 disrupts warm air proximate to heated web 120 by projecting an impinging stream of air onto heated web 120, immediately before heated web 120 enters downstream printer 160. This generates chaotic flow that disrupts the boundary layer on web 120. This is performed immediately before web 120 enters printer 160 and travels past the print heads of printer 160 (e.g., less than a foot before web 120 enters printer 160). Typically, the projected air will be ambient air that is projected at a high speed, but low volume. This ensures that little energy is used to project the air, and also ensures that the temperature of web 120 is not substantially reduced. Thus, web 120 will remain substantially heated before it enters a dryer for printer 160.

In a further embodiment, the amount of airflow, speed of airflow, or temperature of airflow projected by air knife 150 may vary depending on the speed at which web 120 travels, the measured temperature of web 120, or other factors. Without the embodiment described, the thermal boundary layer would be at least an order of magnitude larger than the distance between the web and print heads. Thus, the print heads would be immersed in the highest temperature region of the thermal gradient in the boundary layer. With the embodiment, the thermal boundary layer is disrupted, and the thermal gradient in relation to the time and distance the web travels under the print heads essentially reforms, but never achieves the same gradient it would have without the projected air. Hence, the print heads are immersed or exposed to lower temperatures as the web passes by them. To maximize this effect, airflow generator 150 may be placed as close as possible to the entrance to the print heads to minimize the time that the thermal boundary layer has to re-form before it passes beneath the print heads. However, airflow generator 150 should not be placed so close to the print heads that air flow is disrupted beneath the print heads. Such positioning would adversely impact print quality (i.e., the projected air flow should not interfere with the ejection of ink droplets onto the web).

In step 410, printing system 100 drives heated web 120 underneath print heads of printer 160. This may involve one or more rollers 110 physically driving web 120 through printer 160 for printing. Web 120, as received at printer 160, has been dried by dryer 140, and therefore is heated to some temperature T2 which is hotter than ambient temperature. However, because the boundary layer has been blown off of web 120, the print heads of downstream printer 160 are not heated by conductive or convective heat transfer with a boundary layer of web 120. In short, printing system 100 drives web 120 underneath the print heads of downstream printer 160 before the air proximate to web 120 is restored to a steady-state temperature gradient by web 120. Thus, while web 120 maintains substantially the same temperature T3 that it had prior to entering printer 160, printer 160 is not substantially heated by a boundary layer on web 120. Instead, web 120 takes time to restore its boundary layer to a steady state, and during this time, web 120 passes underneath the print heads of printer 160.

As web 120 moves underneath the print heads of printer 160, the print heads mark web 120. Using method 400 described above, the print heads at a downstream printer are not overheated, even though they print directly onto a heated web of print media. Further, no cooling equipment is required between printers, which saves on energy as well as space within the print shop. At the same time, because the boundary layer of the web has been disrupted without substantially reducing the temperature of the web, the web may be dried using less energy than would be necessary if the web were cooled back to ambient temperature.

While FIGS. 1-4 illustrate the operation of an airflow generator in a multi-printer system, an airflow generator may be used for similar purposes in any number of other scenarios. For example, if an inline paper coating device in a printing system applies a wet surface coating to a web of print media, and that wet surface coating is dried prior to the web entering a printer, an airflow generator could be used to disrupt the heated air on the web before it enters the printer.

In a further embodiment, printer 160 may also compensate for any residual heating of print heads by adjusting the way that marking material is applied by those print heads (i.e., by utilizing a print head temperature compensation scheme). For example, printer 160 may measure the temperature of the various print heads, and may perform Piezo drive voltage adjustments in order to compensate for heating at the print heads. These Piezo drive adjustments may change a Piezo drive's waveform to correct for ink viscosity changes and deliver a consistent drop volume.

Figure 5:
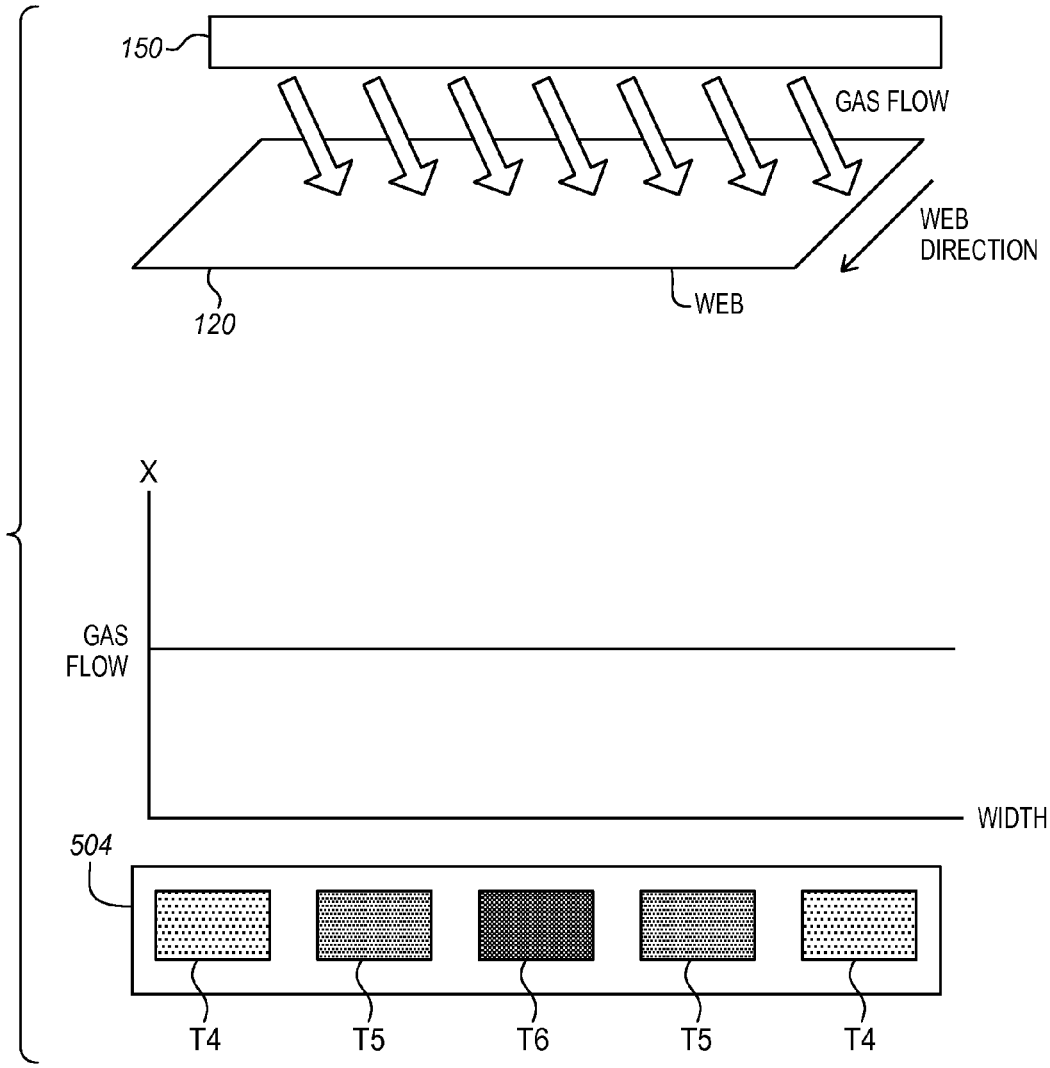
FIG. 5 is a block diagram of an airflow generator applying a consistent flow of gas across the width of a web of print media in an exemplary embodiment.

FIG. 5 is a block diagram of an airflow generator 150 applying a consistent flow of gas across the width of a web of print media 120 in an exemplary embodiment. Thus, FIG. 5 shows that air flow from airflow generator 150 remains constant regardless of whether the air flow strikes the edge of web 120 or the center of web 120. In FIG. 5, transient cooling of web 120 after it has left dryer 140 has created a temperature gradient along the width of web 120. Thus, the center of web 120 remains fairly hot, while the outer portions and the edges are cooler. This means that the center of web 120 may form a larger, stronger, and more resilient boundary layer than the edges.

According to FIG. 5, in one embodiment airflow generator 150 applies a uniform flow of gas to these heated portions of web 120, regardless of whether the portions are at the edge or the center of the web. This may cause the central print head to reach a temperature T6, while the outer print heads reach a temperature T5, even though the print heads at the edge remain at temperature T4.

Figure 6:
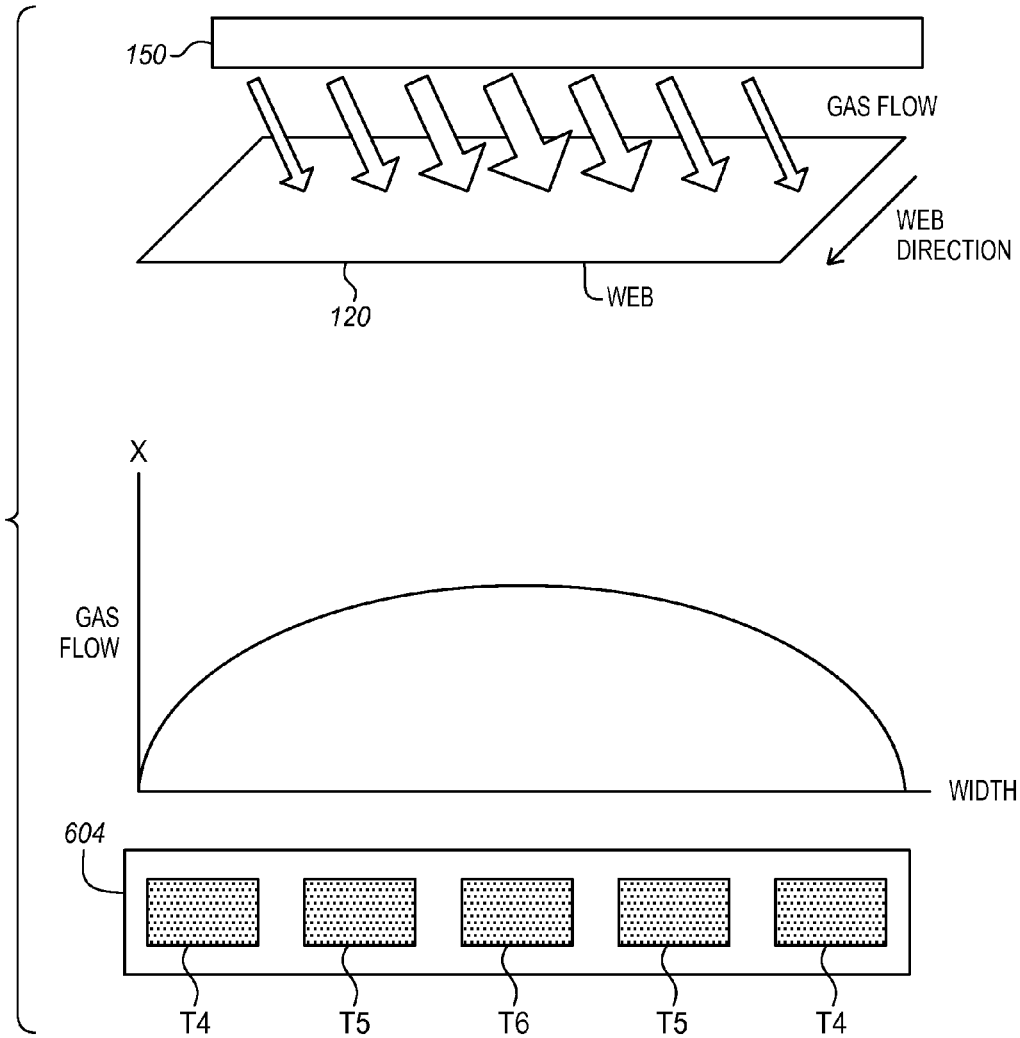
FIG. 6 is a block diagram of an airflow generator applying a varied flow of gas across the width of a web of print media in an exemplary embodiment.

FIG. 6 is a block diagram of airflow generator 150 applying a varied flow of gas across the width of a web of print media in an exemplary embodiment. Thus, if desired, airflow generator 150 may provide different levels of cooling to different portions of web 120. According to FIG. 6, the air applied by airflow generator 150 varies as a function of location along the width of web 120. Note that the variations in air flow may be variations in temperature, mass flow, velocity, or other physical characteristics, but the variation is applied to ensure that the boundary layer at each location along the width of web 120 is fully deflected/disrupted and will not be fully restored by the time that web 120 passes under the print heads of printer 160. Because the boundary layers have been fully disrupted by the varying flow, no differential heating occurs between print heads 604.

Figure 7:
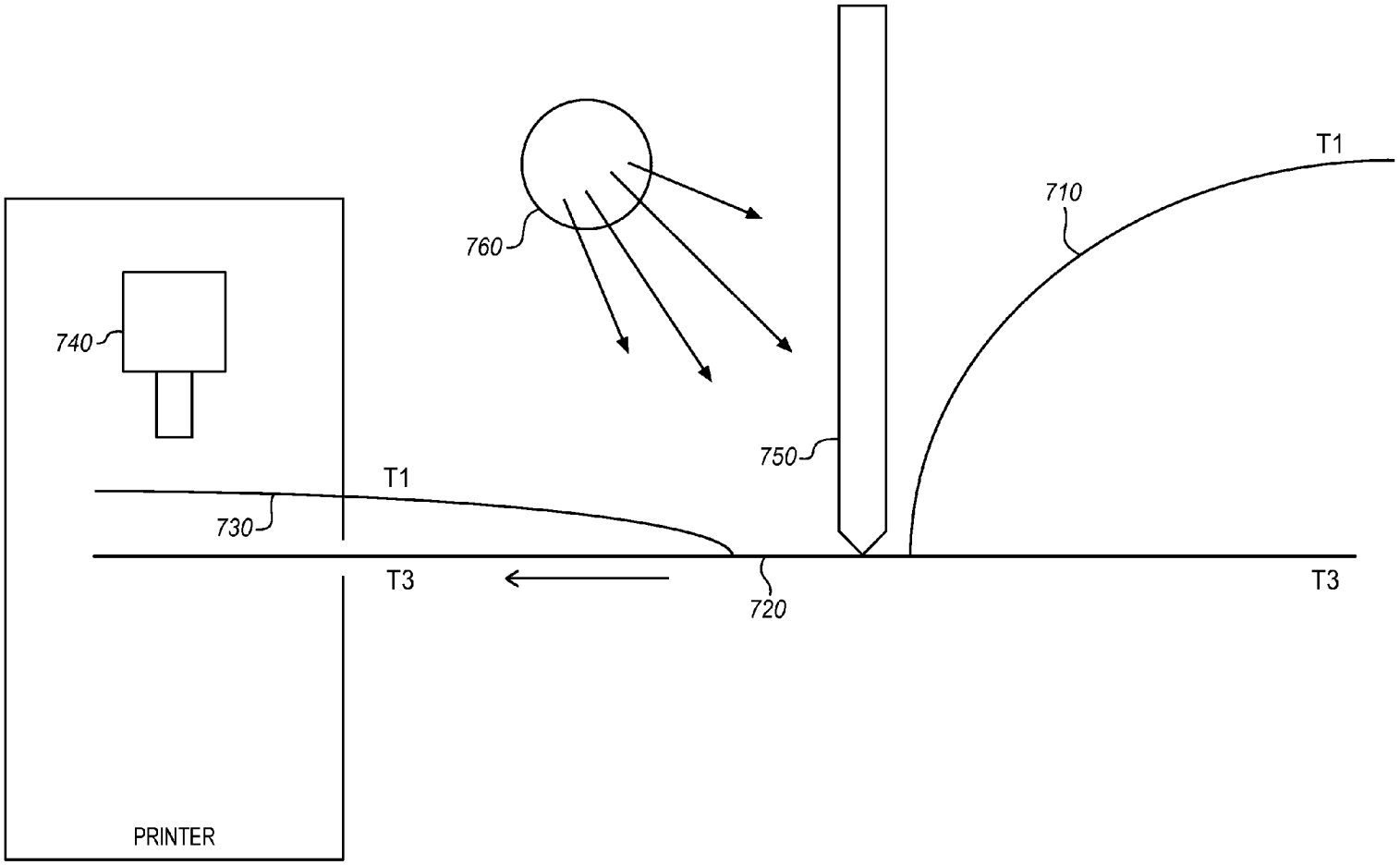
FIG. 7 is a block diagram illustrating a wall placed to disrupt a boundary layer on a web of print media in an exemplary embodiment.

FIG. 7 illustrates an alternate embodiment for deflecting a heated boundary layer from a heated web of print media. FIG. 7 is a block diagram illustrating a wall 750 placed to disrupt a boundary layer on a web of print media in an exemplary embodiment. According to FIG. 7, wall 750 is used instead of airflow generator 150 in order to disrupt a boundary layer at a web of print media. In this embodiment, wall 750 performs a scraping action as web 720 travels underneath it. This pushes heated boundary layer 710 off of web 120. Thus, a new boundary layer 730 is formed, but boundary layer 730 does not achieve a steady, fully developed state until after web 720 passes underneath print head 740. Note that in this embodiment, a fan 760 is included to ensure that wall 750 is not heated to the point where it also generates a boundary layer or contributes to boundary layer 730.

Figure 8:
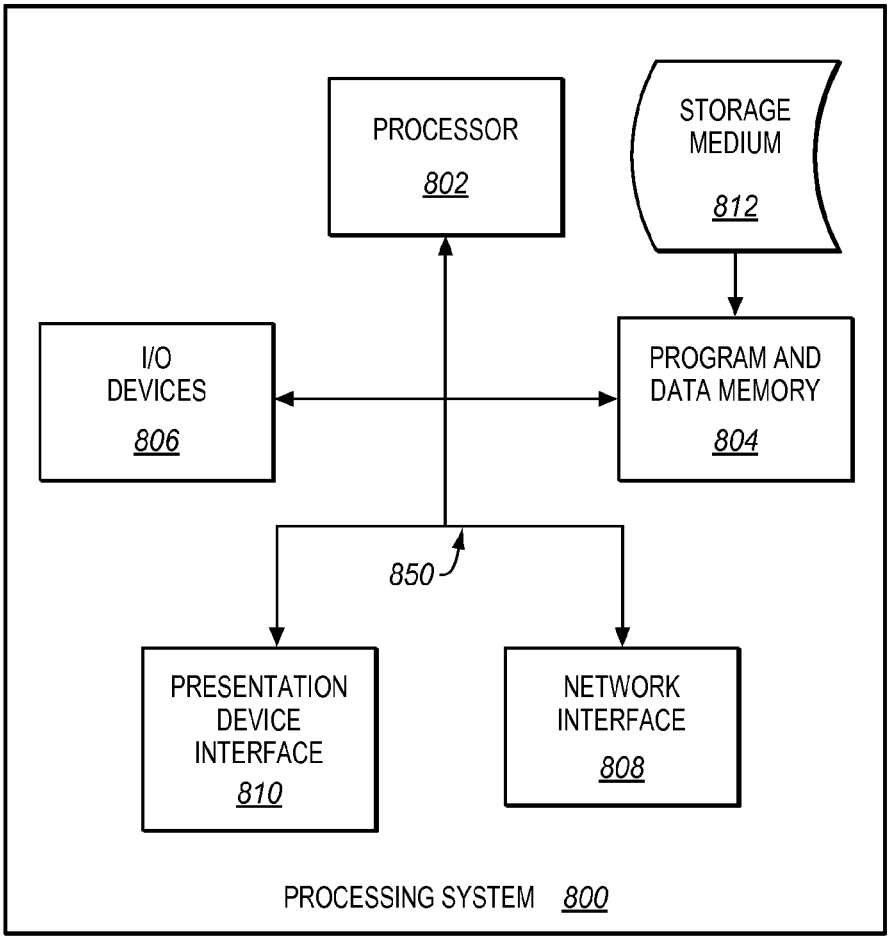
FIG. 8 illustrates a processing system operable to execute a computer readable medium embodying programmed instructions to perform desired functions in an exemplary embodiment.

Embodiments disclosed herein can take the form of hardware, or hardware in various combinations with firmware/software. In one particular embodiment, software is used to direct a processing system of printing system 100 to dynamically adjust an airflow generator (e.g., by adjusting a velocity of airflow, or other characteristics). FIG. 8 illustrates a processing system 800 operable to execute a computer readable medium embodying programmed instructions to perform desired functions in an exemplary embodiment. Processing system 800 is operable to perform the above operations by executing programmed instructions tangibly embodied on computer readable storage medium 812. In this regard, embodiments of the invention can take the form of a computer program accessible via computer-readable medium 812 providing program code for use by a computer or any other instruction execution system. For the purposes of this description, computer readable storage medium 812 can be anything that can contain or store the program for use by the computer.

Computer readable storage medium 812 can be an electronic, magnetic, optical, electromagnetic, infrared, or semiconductor device. Examples of computer readable storage medium 812 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 800, being suitable for storing and/or executing the program code, includes at least one processor 802 coupled to program and data memory 804 through a system bus 850. Program and data memory 804 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 806 (including but not limited to keyboards, displays, pointing devices, etc.) can be coupled either directly or through intervening I/O controllers. Network adapter interfaces 808 may also be integrated with the system to enable processing system 800 to become coupled to other data processing systems or storage devices through intervening private or public networks. Modems, cable modems, IBM Channel attachments, SCSI, Fibre Channel, and Ethernet cards are just a few of the currently available types of network or host interface adapters. Presentation device interface 810 may be integrated with the system to interface to one or more presentation devices, such as printing systems and displays for presentation of presentation data generated by processor 802.

Although specific embodiments were described herein, the scope of the invention is not limited to those specific embodiments. The scope of the invention is defined by the following claims and any equivalents thereof.

We claim:

1. A system comprising:

a receiving printer operable to receive a web of print media heated by an upstream dryer; and an airflow generator located immediately before the heated web enters the receiving printer, the airflow generator operable to project impinging air that deflects warm air proximate to the heated web;

wherein the airflow generator is oriented for the impinging air to strike the web at an angle where a majority of the warm air is deflected away from the receiving printer.

2. The system of claim 1 wherein:

the airflow generator projects the impinging air at a speed that generates turbulent flow at the web that deflects the warm air proximate to the heated web.

3. The system of claim 1 wherein:

the airflow generator projects the impinging air at a rate of mass flow that does not substantially reduce the temperature of the web.

4. The system of claim 1 wherein:

the airflow generator is positioned a distance of not more than one meter from a print head of the receiving printer.

5. The system of claim 1 wherein:

the airflow generator projects the impinging air at a speed of at least twenty feet per second.

6. The system of claim 1 wherein:

one or more nozzles of the airflow generator are positioned a distance of not more than fifty centimeters from the web.

7. The system of claim 1 wherein:

the airflow generator projects the impinging air at a speed that varies between a center of the airflow generator and an edge of the airflow generator.

8. The system of claim 1 wherein the airflow generator projects the impinging air at a temperature that varies between a center of the airflow generator and an edge of the airflow generator.

9. The system of claim 1 wherein the airflow generator projects the impinging air at a rate of mass flow that varies between a center of the airflow generator and an edge of the airflow generator.

10. The system of claim 1 wherein:

the airflow generator comprises an air knife.

11. The system of claim 1 wherein:

the airflow generator is further operable to adjust a speed of the impinging air based upon a speed of the heated web.

12. A method comprising:

driving a web of print media toward a dryer;

heating the web at the dryer;

driving the heated web toward a receiving printer;

projecting impinging air onto the heated web with an airflow generator immediately before the heated web enters the receiving printer in order to deflect warm air proximate to the heated web; and marking the heated web with the receiving printer;

wherein projecting the impinging air is performed at an orientation for the impinging air to strike the web at an angle, where a majority of the warm air is deflected away from the receiving printer.

13. The method of claim 12 wherein:

deflecting the warm air comprises projecting the impinging air at a speed that generates turbulent flow at the web that deflects the warm air proximate to the heated web.

14. The method of claim 12 wherein:

projecting the impinging air is performed at a rate of mass flow that does not substantially reduce the temperature of the web.

15. A system comprising:

a receiving printer operable to mark a heated web of print media that has been heated by an upstream dryer; and a wall tangent to the heated web and located immediately before the heated web enters the receiving printer, the wall operable to physically deflect air proximate to the heated web as the web travels past the wall;

wherein the wall is oriented at an angle where a majority of the warm air is deflected away from the receiving printer.

16. The system of claim 15 wherein:

the wall is cooled to ambient temperature by forced airflow.

17. The system of claim 15 wherein:

the heated web contacts the wall as the heated web travels past the wall.

18. The system of claim 15 wherein:

the wall does not change the direction of travel of the heated web.

* * * * *